US010194705B2

(12) United States Patent
Amrhein et al.

(10) Patent No.: US 10,194,705 B2
(45) Date of Patent: Feb. 5, 2019

(54) EXERCISE APPAREL WITH ATTACHED LIFTING STRAPS

(71) Applicants: Colleen Amrhein, Tinton Falls, NJ (US); Timothy John Amrhein, Tinton Falls, NJ (US)

(72) Inventors: Colleen Amrhein, Tinton Falls, NJ (US); Timothy John Amrhein, Tinton Falls, NJ (US)

( * ) Notice: Subject to any disclaimer, the term of this patent is extended or adjusted under 35 U.S.C. 154(b) by 285 days.

(21) Appl. No.: 15/049,226

(22) Filed: Feb. 22, 2016

(65) Prior Publication Data

US 2016/0249690 A1 Sep. 1, 2016

Related U.S. Application Data

(60) Provisional application No. 62/121,188, filed on Feb. 26, 2015.

(51) Int. Cl.
*A41D 13/00* (2006.01)
*A41D 27/10* (2006.01)

(52) U.S. Cl.
CPC ..... *A41D 13/0015* (2013.01); *A41D 27/10* (2013.01); *A41D 2200/20* (2013.01)

(58) Field of Classification Search
CPC ..... A41D 13/0015; A41D 27/10; A41D 2200/20; A41D 13/08; A41D 13/088
USPC ..... 2/84, 270
See application file for complete search history.

(56) References Cited

U.S. PATENT DOCUMENTS 359,330 A * 3/1887 Smadbeck ..... A41D 13/08 2/59
850,721 A * 4/1907 Barnes ..... A41D 27/10 2/101
1,012,648 A * 12/1911 Karp ..... A41D 27/10 2/270
1,061,686 A * 5/1913 Nichols ..... A41D 13/08 2/270
1,328,545 A * 1/1920 O'Shea ..... A41D 27/10 2/161.1
1,338,098 A * 4/1920 Schneider ..... A41D 27/10 2/101
1,361,565 A * 12/1920 Christy ..... A41D 19/0041 2/158
2,388,330 A * 11/1945 Jungmann ..... A41D 13/088 2/16
2,686,913 A * 8/1954 Brierley ..... A41B 13/00 2/111
3,496,572 A * 2/1970 Benno ..... A41D 13/02 2/232
3,564,613 A * 2/1971 Fowler ..... A41D 13/088 2/159
4,601,066 A * 7/1986 Campbell ..... A41D 1/04 2/123
4,676,561 A * 6/1987 Barrett, II ..... H01R 4/64 361/220
D295,575 S * 5/1988 Campbell ..... 2/115
(Continued)

*Primary Examiner* — Alissa L Hoey
(74) *Attorney, Agent, or Firm* — Dunlap Bennett & Ludwig PLLC; Brendan E. Squire

(57) ABSTRACT

Long sleeve exercise apparel with weight lifting wrist wraps/lifting straps attached at the cuffs of the sweatshirt sleeves. The invention is the ultimate lifting sweatshirt. It is a sweatshirt that is used as a training aide to force users to sweat more and lose more weight, all while providing wrist support and aiding in allowing the user to lift more than usual by enhancing ones grip.

11 Claims, 4 Drawing Sheets

(56) References Cited

U.S. PATENT DOCUMENTS 4,944,041 A * 7/1990 Buenos ..... A41D 19/0041 2/84
5,103,502 A * 4/1992 Grilliot ..... A41D 27/10 2/123
5,182,812 A * 2/1993 Goldsby ..... A61H 36/00 2/227
5,313,667 A * 5/1994 Levine ..... A41D 13/088 2/16
5,504,944 A * 4/1996 Bromer ..... A41D 19/01 2/125
5,557,806 A * 9/1996 Caswell ..... A41D 19/01547 2/161.1
5,745,920 A * 5/1998 Olivier ..... A63B 21/4019 2/161.1
5,857,947 A * 1/1999 Dicker ..... A63B 21/00185 2/69.5
6,168,556 B1 * 1/2001 Saavedra ..... A63B 21/4019 224/220
8,341,772 B1 * 1/2013 Flores ..... A41D 13/0015 2/460
9,009,865 B2 * 4/2015 Gilreath ..... A41B 7/02 2/123
9,364,038 B2 * 6/2016 Barrett ..... A42B 1/048
9,603,399 B1 * 3/2017 Scemla ..... A41D 27/10
2004/0133967 A1 * 7/2004 West ..... A41D 27/10 2/247
2005/0028242 A1 * 2/2005 Thomas ..... A41D 1/04 2/84
2008/0120759 A1 * 5/2008 Tolton ..... A41D 27/10 2/87
2012/0144544 A1 * 6/2012 Telfer ..... A41D 19/0041 2/20
2014/0047614 A1 * 2/2014 Becton ..... A41D 1/00 2/84
2015/0351458 A1 * 12/2015 Fisher ..... A41B 7/02 2/270
2016/0135525 A1 * 5/2016 Colleran ..... A41D 27/10 2/69
2016/0199684 A1 * 7/2016 Gottfried ..... A41B 1/08 2/69
2016/0213504 A1 * 7/2016 Colleran ..... A61F 5/013

* cited by examiner

EXERCISE APPAREL WITH ATTACHED LIFTING STRAPS

CROSS-REFERENCE TO RELATED APPLICATION

This application claims the benefit of priority of U.S. provisional application No. 62/121,188, filed Feb. 26, 2015, the contents of which are herein incorporated by reference.

BACKGROUND OF THE INVENTION

The present invention relates to exercise apparel and, more particularly, to exercise apparel for weight lifting exercises.

Often when weight lifting or lifting heavier objects, one needs wrist support to aide in protection of hurting oneself. At times, sleeves can get in the way or, as the supports loosen, constant adjustment is needed for wraps/straps; resulting in readjustment or constant removal and reapplication of the wrist supports. Also, weight lifters are constantly misplacing their wrist supports and lifting straps, whether at home or leaving them forgetfully at the gym or workout facility.

The present invention is the ultimate lifting sweatshirt. It is a sweatshirt that is used as a training aide to force users to sweat more and lose more weight, all while providing wrist support and aiding in allowing the user to lift more than usual by enhancing ones grip.

As can be seen, there is a need for an exercise apparel with attached lifting straps and wrist wraps.

SUMMARY OF THE INVENTION

In one aspect of the present invention, an article of exercise apparel, includes: a long sleeve shirt adapted to be worn by a user, the shirt having a left sleeve and a right sleeve that terminate at a cuff; an elastic cuff, operatively attached to the cuff; a lift wrap having a first end operatively coupled to the elastic cuff, the lift wrap having a length adapted to wrap, at least once around a user's wrist; a wrap tab attached to a second end of the lift wrap; and a wrap patch attached to a surface of the lift wrap intermediate the first end and the second end of the lift wrap. The article of apparel may also include a thumb loop operatively attached to the elastic cuff. In some embodiments, the article includes a lift strap, operatively attached to the cuff at a palmar portion thereof, the lift strap is oriented to extend from the elastic cuff and generally perpendicular to the elastic cuff. In other embodiments, the apparel may also include a securement strap attached to a lower portion of a sleeve adapted to receive a free end of the lift strap. The securement strap may be formed of a hook and loop material. Similarly, the wrap patch and the wrap tab are formed of cooperating hook and loop material. The long sleeve shirt may also include a hood extending from a neck portion of the long sleeve shirt.

In other aspects of the invention an article of exercise apparel, includes a long sleeve shirt adapted to be worn by a user, the shirt having a left sleeve and a right sleeve that terminate at a cuff; an elastic cuff, operatively attached to the cuff; a lift wrap having a first end operatively coupled to the elastic cuff, the lift wrap having a length adapted to wrap, at least once around a user's wrist; and a thumb loop operatively attached to the elastic cuff. A wrap tab may be attached to a second end of the lift wrap; and a wrap patch may be attached to a surface of the lift wrap intermediate the first end and the second end of the lift wrap. In some embodiments, a lift strap is operatively attached to the cuff at a palmar portion thereof, the lift strap oriented to extend from and generally perpendicular to the elastic cuff. In other embodiments, a securement strap is attached to a lower portion of a sleeve and is adapted to receive a free end of the lift strap. The securement strap is formed of a hook and loop material. Similarly, the wrap patch and the wrap tab are preferably formed of a cooperating hook and loop material. The long sleeve shirt may also include a hood extending from a neck portion of the long sleeve shirt.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides the ultimate lifting sweatshirt. The sweatshirt is used as a training aide to force users to sweat more and lose more weight, all while providing wrist support and aiding in allowing the user to lift more than usual by enhancing ones grip.

Figure 1:
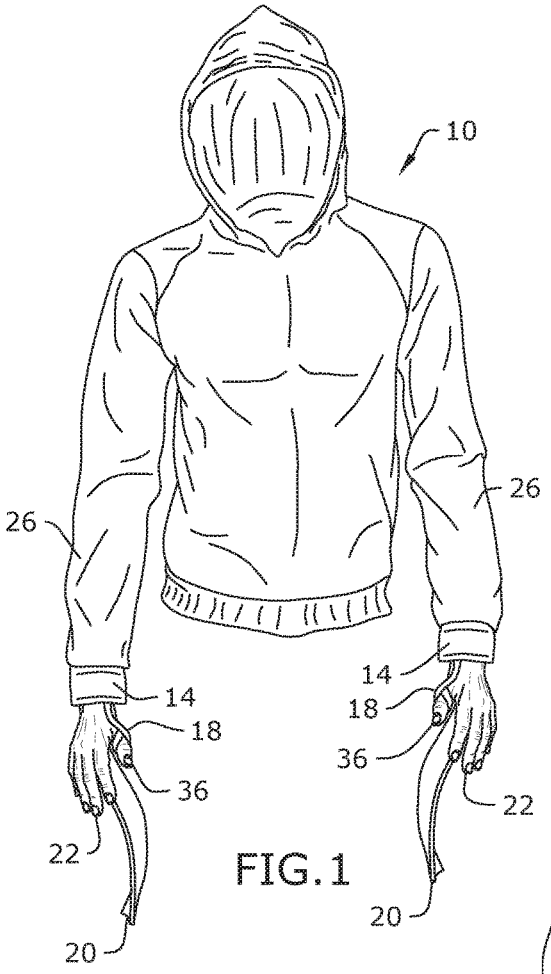
FIG. 1 is a front perspective view of the invention shown in use with the straps unsecured.
Figure 2:
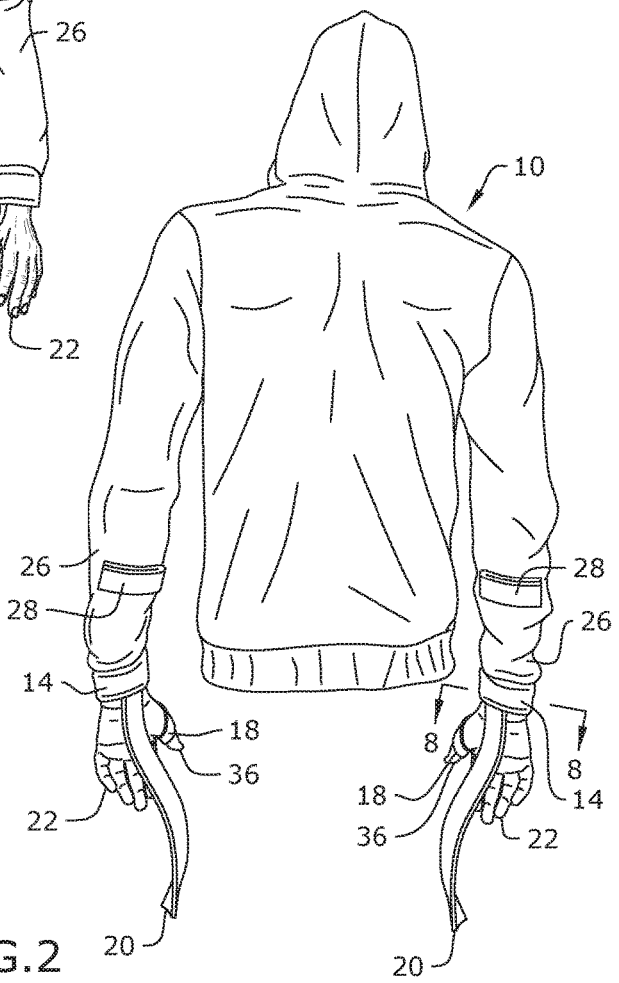
FIG. 2 is a rear perspective view of the invention shown in use with the straps unsecured.
Figure 3:
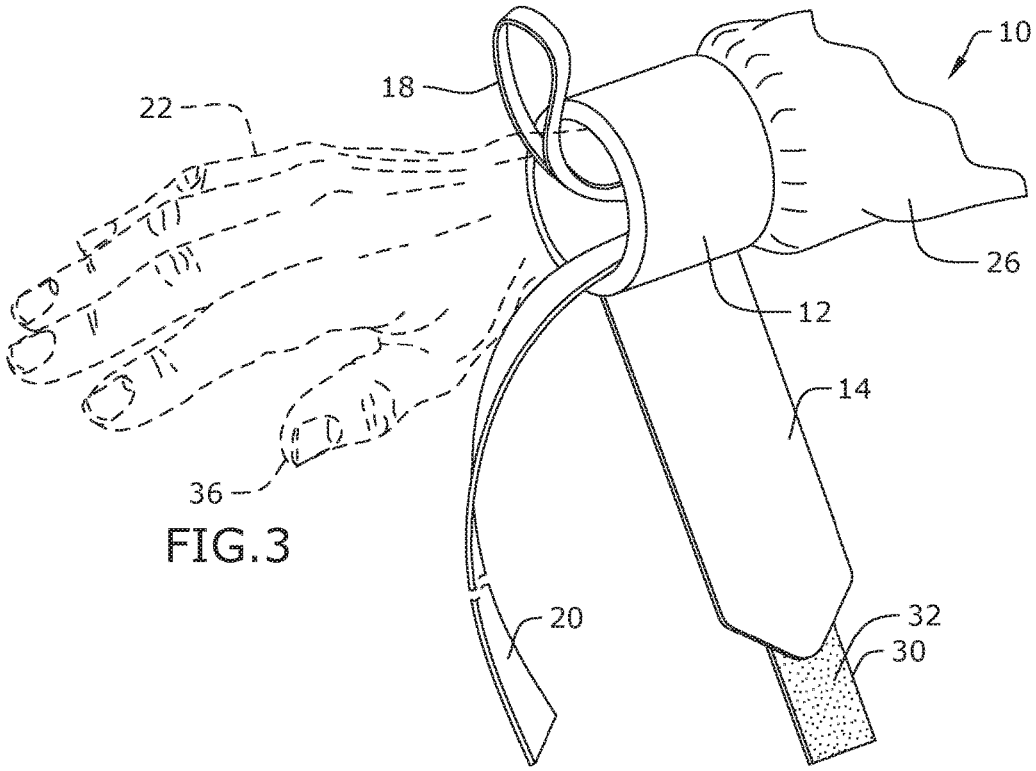
FIG. 3 is a detail perspective view of the invention.
Figure 4:
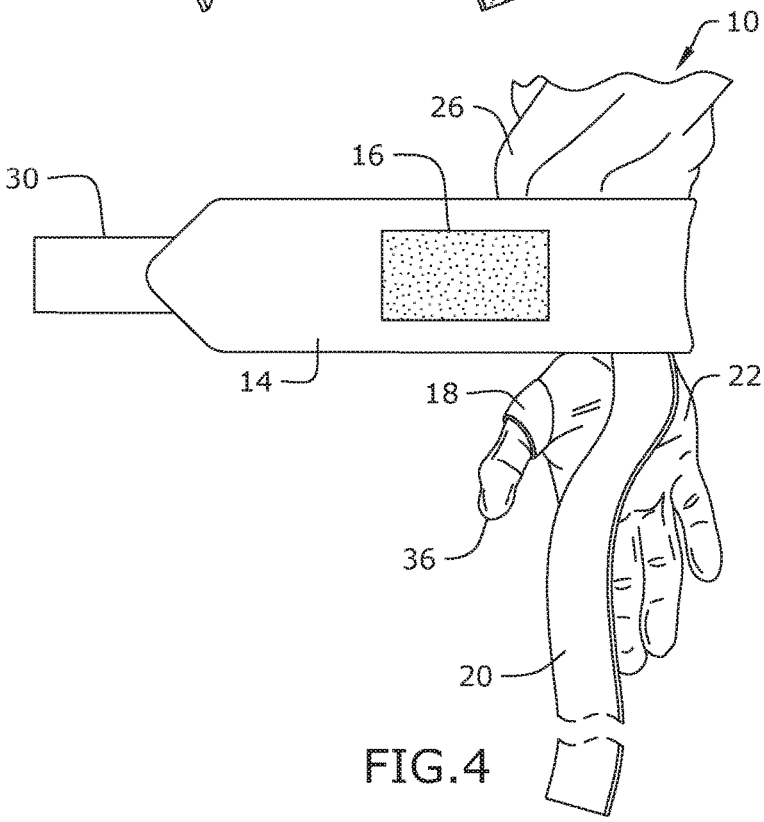
FIG. 4 is a rear detail view of the invention shown with wrap in an exemplary initial configuration.
Figure 5:
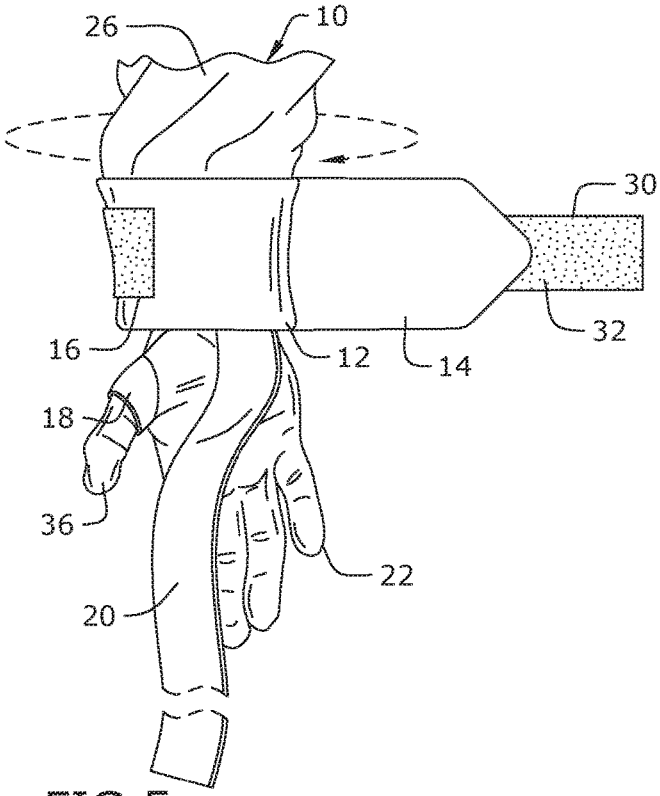
FIG. 5 is a rear detail view of the invention shown with wrap in an exemplary secondary configuration.
Figure 6:
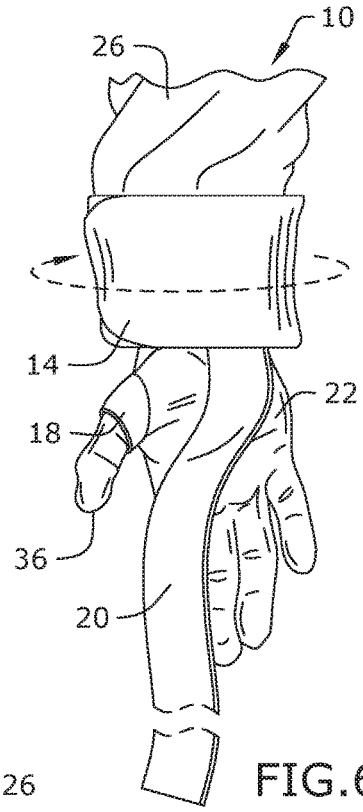
FIG. 6 is a rear detail view of the invention shown with wrap in an exemplary tertiary configuration.
Figure 7:
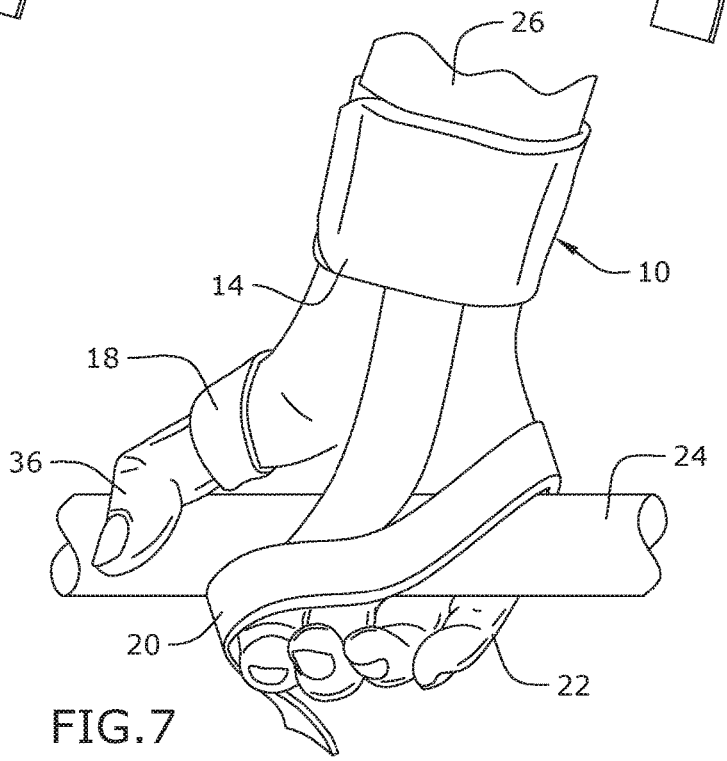
FIG. 7 is a perspective detail view of the invention shown in use during lift.
Figure 8:
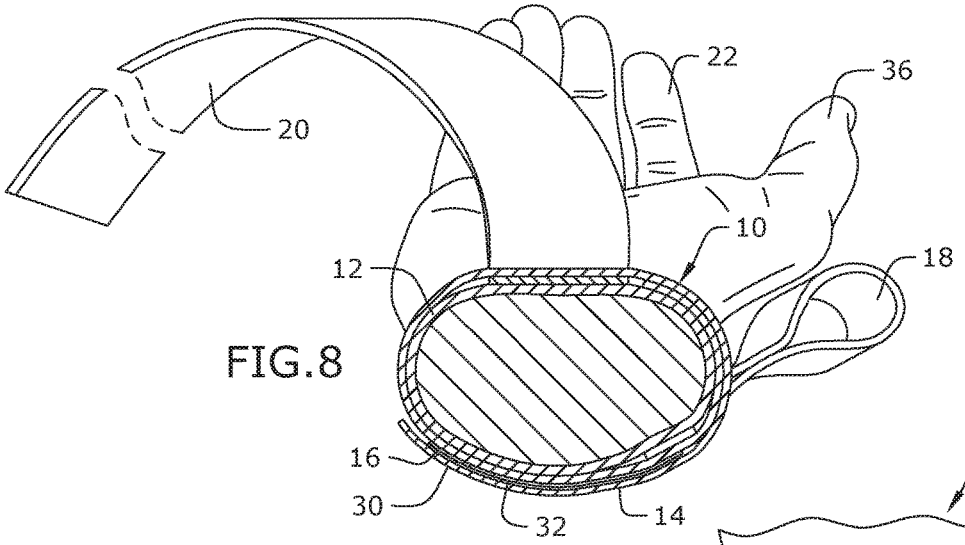
FIG. 8 is a section detail view of the invention taken along line 8-8 in FIG. 2.
Figure 9:
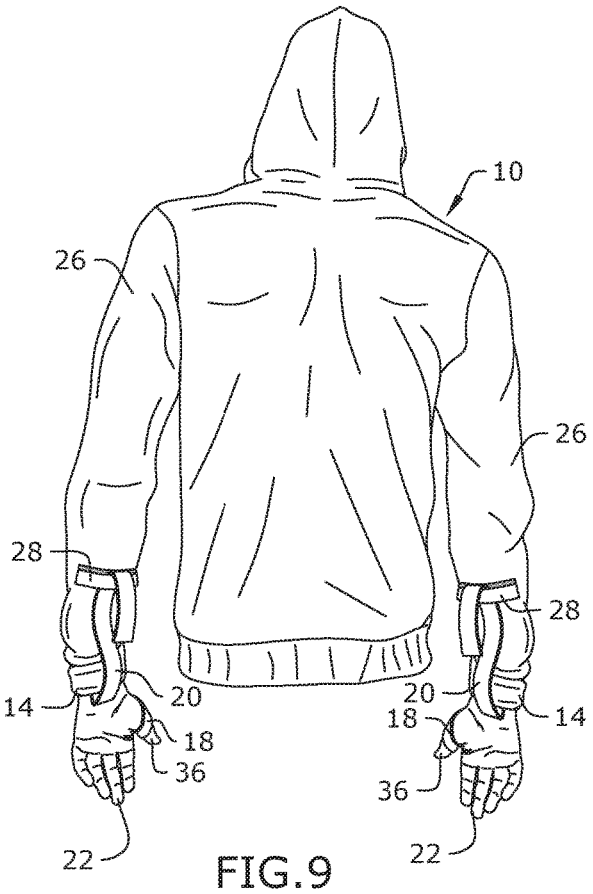
FIG. 9 is a rear perspective view of the invention shown with items 20 weight straps in secured configuration.
Figure 10:
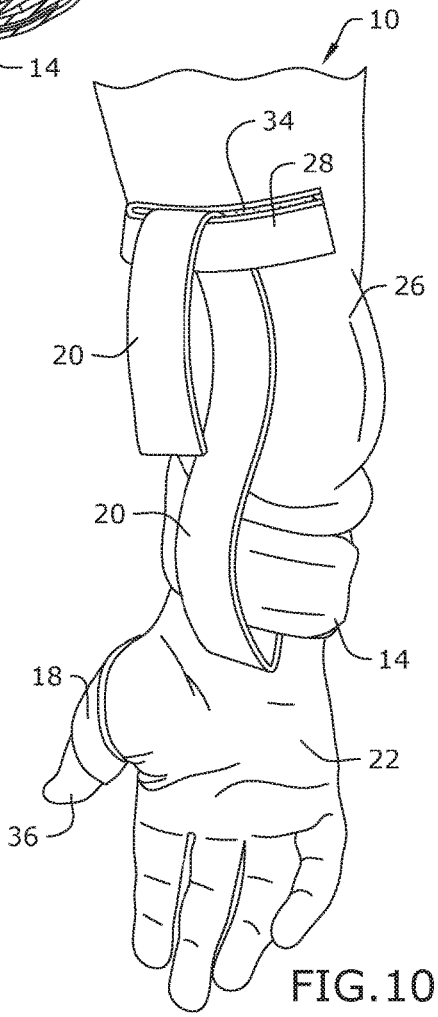
FIG. 10 is a rear detail perspective view of the invention shown with item 20 weight strap in secured configuration.

As best seen in reference to FIGS. 1 and 2, the exercise apparel with attached lifting straps 10 is shown with a lift wrap 14 attached via an elastic cuff 12 to a left and a right sleeve 26. The long sleeve apparel 10, may include a sweat shirt, a T-shirt, or other long sleeve exercise shirt. The shirt 10 may be formed of any suitable material for an exercise garment, such as woven cotton, polyester, nylon, rayon, or blends thereof. The exercise garment 10 may also be formed of a material that is substantially impervious to air circulation, to enhance sweating during an exercise routine.

The lift wrap 14 may include the base elastic cuff 12, a thumb strap 18 and a weight strap 20 that the user may utilize to assist in performing weight lifting exercises, or otherwise to assist with other lifting purposes. The sleeves 26 of the garment may also be provided with a sleeve attachment 28 to secure the free ends of the weight strap 20 to prevent them from dangling or otherwise interfere with the user while not in use. The sleeve attachment 28 may include a strap of cooperating hook and loop material, or may be made of an elastic or other material to secure the weight strap 20 when not in use.

As seen in reference to FIGS. 3-10, the lift wrap 14 attaches at a first end to the elastic cuff 12 base, preferably proximal to a palmar portion of the user's wrist. The lift wrap 14 has a length of not less than 12" and is configured such that the wrap 14 may completely encircle the wearer's wrist, at least once, and preferably one and a half rotations about the wrist. A wrap tab 30 is attached near a second free end of the lift wrap 14. The wrap tab 30 may extend past the free end of the lift wrap 14, or may be attached to a surface of the lift wrap proximal to the free end. A wrap patch 16 is attached to a surface of the lift wrap 14 for removably attaching the wrap tab 30 and securing the free end of the lift wrap 14 in a supporting engagement about the wearer's wrist while lifting. The positioning and length of the wrap patch 16 and wrap tab 30 are selected to permit the user to variably adjust the tension of the lift wrap 14 around the user's wrist. Preferably, the wrap tab 30 and wrap patch 16 are formed of a cooperating hook and loop material. More preferably, the length of the lift wrap 14, and positioning of wrap patch 16 are selected such that the wrap tab 30 may be attached to the wrap patch 16 at a dorsal aspect of the user's wrist. As will be appreciated, the lengths of the lift wrap 14 may be selected to correspond to a size of the apparel to which the lift wrap 14 is secured.

A thumb loop 18 is provided by folding over a length of strap material onto itself to define the thumb loop 18 at a first end. A second end of the strap is operatively attached to the cuff 12, preferably aligned with the line of the user's thumb 36 and the wrist. The thumb loop 18 may be used to assist the user with maintaining the cuff 12 in proper orientation with respect to the user's wrist while the user wraps the lift wrap 14 around their wrist.

The lift wrap 14 may further comprise a weight strap 20 attached at a first end to the cuff 12 along a palmar aspect of the cuff 12. As best seen in reference to FIGS. 5-7, the weight strap 20 is oriented such that it will lie along the length of the palm 22 of the user's hand. The weight strap 20 has a length sufficient to wrap at least once around a bar 24 of a piece of exercise equipment, such as a barbell, a dumbbell, a chin-up bar, and the like. The strap 20 may have an additional length such that it may wrap around the users hand 22. A second free end of the weight strap 20 is retained against the bar 24 when the user grips the bar 24 to conduct their exercise routine, otherwise engage in their activities.

The present invention is used by those who have a need or desire to lift heavier objects, such as exercising with weights, or those in need of wrist supports when engaged in other activities. The user would wear the garment 10 of the present invention like any other long sleeve article of clothing and simply adjust the lift wraps 14 that are attached to the end of the sleeves 36 according to their needs. The hook and loop material 32 on tab 30 and patch 16 allows the user room for adjustment and a variable level of tension on wrists.

When lifting heavier objects or weight lifting, the user would tighten the wraps 14 to their needs. When support is not needed, the user would simply loosen the wraps 14 on wrists. In order to lift a heavier amount of weights, a user may use the lifting straps 20 to wrap around weight bar 24 to aide in grip enhancement and provide extra holding support to keep weights in their hands 22 throughout the exercise. The lifting straps 20 may be secured out of the way with the securement straps 28. Using the present invention and wearing it would eliminate the loss of wrist supports 14 and lifting straps 20 that may otherwise be left about the gym, locker room, or workout area.

It should be understood, of course, that the foregoing relates to exemplary embodiments of the invention and that modifications may be made without departing from the spirit and scope of the invention as set forth in the following claims.

What is claimed is:

1. An article of exercise apparel, comprising:

a long sleeve shirt adapted to be worn by a user, the shirt having a left sleeve and a right sleeve that terminate at a distal portion;

an elastic cuff attached to the distal portion;

a lift wrap having a first end coupled to the elastic cuff, the lift wrap having a length adapted to wrap, at least once around a user's wrist, to apply a supporting tension to the user's wrist;

a wrap tab attached to a second end of the lift wrap;

a thumb loop attached to the elastic cuff;

a wrap patch attached to a surface of the lift wrap intermediate the first end and the second end of the lift wrap, wherein the wrap tab and the wrap patch are configured to cooperatively engage each other to adjustably apply the supporting tension, and a weight strap, attached to the elastic cuff at a palmar portion thereof, the weight strap oriented to extend from the elastic cuff aligned with a longitudinal length of the left sleeve and the right sleeve, the weight strap having a length sufficient to wrap around an exercise bar and configured to be gripped by the user's hand.

2. The article of claim 1, further comprising:

a securement strap attached to a lower portion of the left sleeve and the right sleeve adapted to receive a free end of the weight strap.

3. The article of claim 2, wherein the securement strap is formed of a hook and loop material.

4. The article of claim 1, wherein the wrap patch and the wrap tab are formed of cooperating hook and loop material.

5. The article of claim 1 further comprising:

a hood extending from a neck portion of the long sleeve shirt.

6. An article of exercise apparel, comprising:

a long sleeve shirt adapted to be worn by a user, the shirt having a left sleeve and a right sleeve that terminate at a distal end;

an elastic cuff, operatively attached to the distal end;

a lift wrap configured to adjustably apply a supporting tension around the user's wrist, the lift wrap having a first end attached to the elastic cuff, the lift wrap having a length adapted to wrap, at least once around a user's wrist;

a weight strap having a first end attached to a palmar portion of the elastic cuff and a second end oriented to extend from the elastic cuff aligned with a longitudinal length of the left sleeve and the right sleeve, the weight strap having a length sufficient to wrap around an exercise bar upon which the user is exercising; and a thumb loop, defined by joined ends of a length of strap folded onto itself with the joined ends attached to the elastic cuff.

7. The article of claim 6, further comprising:

a wrap tab attached to a second end of the lift wrap; and a wrap patch attached to a surface of the lift wrap intermediate the first end and the second end of the lift wrap.

8. The article of claim 7, further comprising:

a securement strap attached to a lower portion of the left sleeve and the right sleeve adapted to receive a free end of the weight strap.

9. The article of claim 8, wherein the securement strap is formed of a hook and loop material.

10. The article of claim 7, wherein the wrap patch and the wrap tab are formed of cooperating hook and loop material.

11. The article of claim 7 further comprising:

a hood extending from a neck portion of the long sleeve shirt.

* * * * *